United States Patent [19]

Moreno

[11] 4,161,369

[45] Jul. 17, 1979

[54] LOADER BOOM ASSEMBLY

[75] Inventor: Emil F. Moreno, Melrose Park, Ill.

[73] Assignee: International Harvester Company, Chicago, Ill.

[21] Appl. No.: 764,781

[22] Filed: Feb. 2, 1977

[51] Int. Cl.[2] ..... E02F 3/81

[52] U.S. Cl. ..... 414/722; 212/144

[58] Field of Search ..... 214/145 R, 152; 212/144; 182/228; 403/244, 253, 263; 280/106 R, 106 T, 279, 280

[56] References Cited

U.S. PATENT DOCUMENTS

| | | | |
|---|---|---|---|
| 1,992,710 | 2/1935 | Matthaei | 280/106 R |
| 2,173,525 | 9/1939 | Wallace | 280/106 R |
| 3,058,777 | 10/1962 | Froedge | 182/228 |
| 3,254,780 | 6/1966 | Midtbo | 214/145 R |

FOREIGN PATENT DOCUMENTS

| | | | |
|---|---|---|---|
| 521446 | 8/1957 | Italy | 182/228 |
| 175157 | 2/1922 | United Kingdom | 182/228 |

*Primary Examiner*—Trygve M. Blix
*Assistant Examiner*—Ross Weaver
*Attorney, Agent, or Firm*—William H. Wendell; Ronald C. Kamp; F. David AuBuchon

[57] ABSTRACT

A boom assembly for a loader that is pivotally mounted on a tractor. The assembly includes a pair of boom arms which are pivotally connected at one end of the tractor. The arms are fabricated from two C-channels which are welded together. The arms have aligned inside apertures sized to accept a cross tie member which is rigidly connected to both channels.

2 Claims, 6 Drawing Figures

FIG. 1
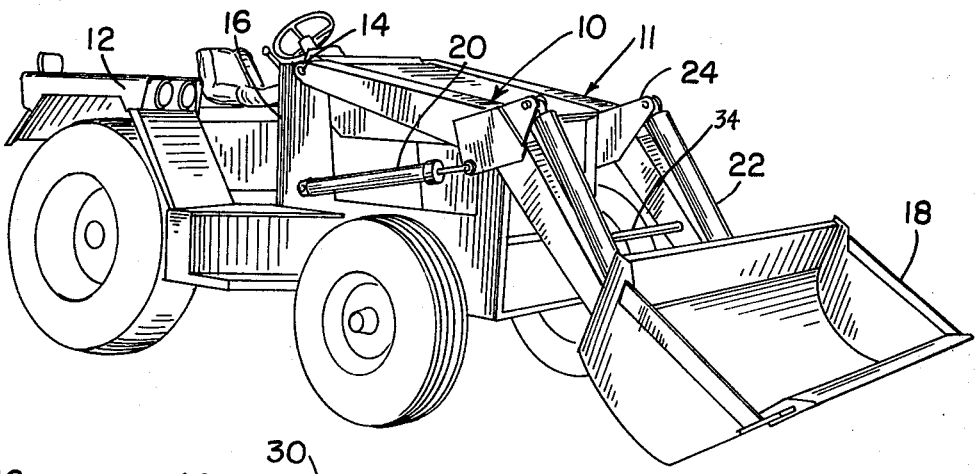
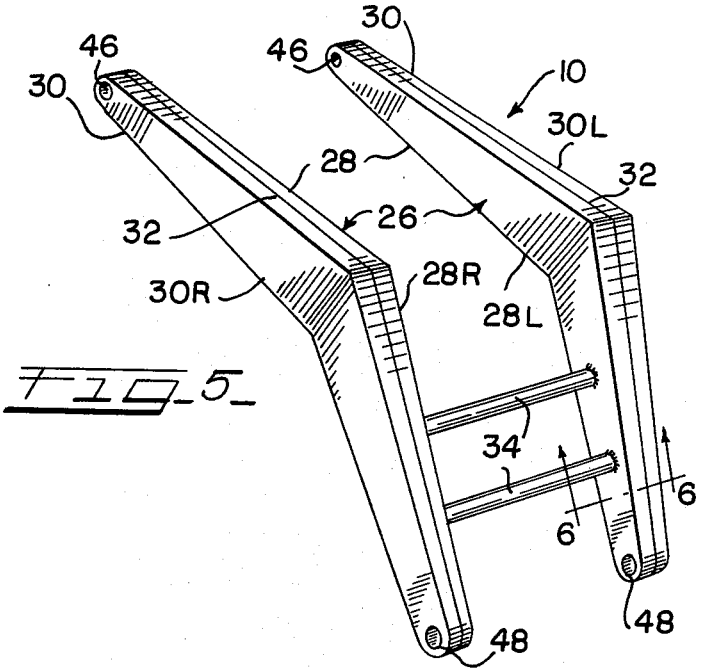
FIG. 5
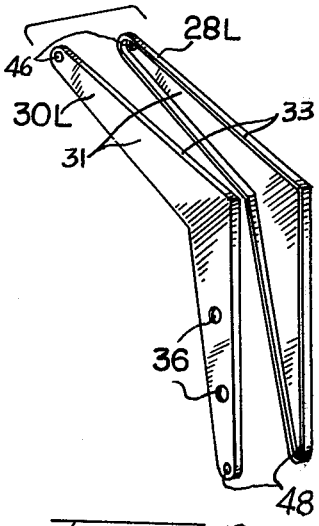
FIG. 2
FIG. 6
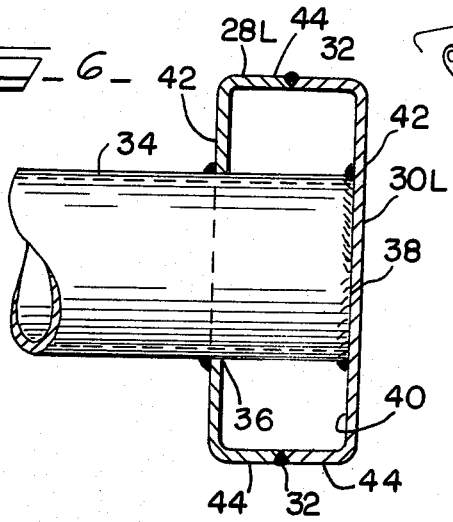
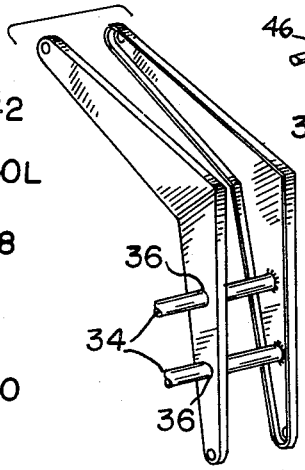
FIG. 3
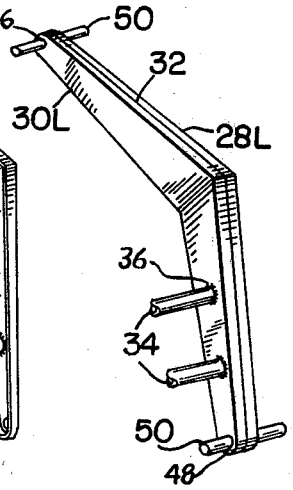
FIG. 4

LOADER BOOM ASSEMBLY

BACKGROUND OF THE INVENTION

This invention relates generally to tractor loaders and, more particularly, concerns the boom assembly of the loaders.

The conventional arrangement for a loader boom assembly consists of a pair of boom arms which are spaced apart by cross tie members that maintain a uniform distance between the boom arms. The three basic configurations of the boom arms are a solid plate, a box structure formed by a single, multiple bend, wraparound sheet and a box structure formed by welding two C-channels.

Although the solid plate and the single piece wraparound boom configurations have the best strength characteristics, the expense of obtaining a plate of proper thickness and size, and the expense of forming the single piece wraparound box have made the seat channel box configuration the most popular among today's manufacturers because of its lower manufacturing cost. The use of this least expensive C-channel box boom structure has presented design difficulties because it includes four bends and a continuous weld between the channels which weaken the structure in the twisting load mode. To overcome this weakness the position setting cross tie members have been extended completely through both channels and have been welded to both channels to supply the necessary twisting strength to the configuration.

When the cross ties were modified in this manner to perform a dual function, the design change produced a multiplicity of problems for the industry. The first of these problems arose from the modifications in the assembly procedure that were necessitated by the structural change in the boom assembly. The new assembly procedure as set forth in U.S. Pat. No. 3,254,780 issued on June 7, 1966, in which the assembly sequence of welding the C-channels into a box structure, cutting the holes for the boom implement and cross tie member and welding the cross tie members to both boom arms. This assembly sequence increases the cost of manufacturing the boom assembly because it requires a very accurate forming of the individual C-channels and a drilling process to produce the necessary holes.

Three other difficulties with this passthrough cross tie configuration involve weaknesses in the actual structure of the assembly. The first of the structural weaknesses is caused by the stress risers which are produced in the C-channels when the cross tie holes are drilled therein. Although the embracing effect of the passthrough cross ties does increase the twisting strength of the boom arms, the holes in the sides of the boom arms cause stress risers which decrease the strength of the assembly in the normal straight lifting mode. The remaining two structural weaknesses are the result of the dirty and damp environment in which the tractor loaders operate. This environment will weaken the passthrough cross ties by exposing the external welds of the cross ties to rust, and will also attack the integrity of the cross tie itself by filling the open ended cross tie with dirt and moisture that once again will weaken the structure through rust.

It is, therefore an object of the present invention to provide a C-channel boom arm which has increased twist strength with minimal effect on the strength of the boom arm in other loading modes.

Additionally, it is an object of the present invention to provide a C-channel boom arm with increased twist strength of the arm without increasing its susceptibility to the corrosive environment in which it must operate.

Further it is an object of the invention to provide a method of fabricating the above-described boom arm assembly which maximizes the efficiency of the fabrication thereby minimizing the expense of the process.

SUMMARY OF THE INVENTION

In accordance with the invention there is provided a boom assembly for a loader that is pivotally mounted on a tractor part. The assembly includes a pair of boom arms which are pivotally connected at one end to the tractor. The arms are fabricated from two C-channels which are welded together. The arms have aligned inside apertures sized to accept a cross tie member which is rigidly connected to both channels.

BRIEF DESCRIPTION OF THE DRAWINGS

Other objects and advantages of the invention will become apparent upon reading the following detailed description and upon reference to the drawings, in which:

FIG. 1 is a right side perspective view of a tractor and loader incorporating the present invention's boom assembly.

FIG. 2 is a figure showing the first step in the assembly procedure for the boom arm;

FIG. 3 is a figure showing the second step in the assembly procedure for the boom arm;

FIG. 4 is a figure showing the third step in the assembly procedure for the boom arm;

FIG. 5 is a perspective view of the boom arm assembly;

FIG. 6 is a sectional view taken along line 6—6 of FIG. 4.

While the invention will be described in connection with a preferred embodiment and procedure, it will be understood that it is not intended to limit the invention to that embodiment and procedure. On the contrary, it is intended to cover all alternatives, modifications, and equivalents as may be included within the spirit and scope of the invention as defined by the appended claims.

DETAILED DESCRIPTION OF THE INVENTION

Turning first to FIG. 1, the boom assembly 10 of the present invention is shown mounted on a tractor 12 by a pivotal connection 14 to the tractor body 16. In the preferred embodiment the implement, a bucket 18, is pivotally connected to the forward portion of the boom assembly 10. Both the boom assembly and the bucket are controlled through hydraulic cylinders 20 and 22, respectively, of the tractor 12 through pivot plates 24 which are attached to the boom assembly 10.

Although the bucket and hydraulic control arrangement of the above-described tractor loader 11 are conventional, the boom arm assembly, shown in more detail in FIGS. 2 through 6, is not a conventional boom arm assembly. As shown in FIG. 5 the unique boom arm assembly 10 of the present invention includes two boom arms 26 which are fabricated from matched pairs of inner C-channels 28 and outer C-channels 30 which are welded together along line 32. In the preferred embodiment the boom arms 26 are spaced apart by a pair of tubular cross tie members 34 forward of the tractor 12.

A detailed examination of the boom arms 26, see FIG. 2, will show that the left hand inner C-channel 28L and the left hand outer C-channel 30L are identical except for the cross tie apertures 36 in the inner channels 28L. The same relationship exists between the right hand inner channel 28R and the right hand outer channel 30R. In view of this mirror image relationship between the boom arm C-channels, the following description of the assembly sequence will focus on only the left hand boom arm and the cross ties.

The first step of the preferred method of boom assembly construction is shown in FIG. 2 which depicts the formed and punched inner C-channel 28L and outer C-channel 30L. In this first step the sheet metal blanks of the C-channels are punched and formed into the shapes depicted in FIG. 2. The inner C-channels contains boom pivot apertures 46, bracket pivot apertures 48 and cross apertures 36 in its vertical surface 31. The second step in the preferred method is to form the cross ties 34 in the proper spacing length and sized diameter. When the four C-channels and the crossed tie members have been formed, the cross tie members are passed through the inner C-channels 28L and 28R and are welded in their proper position on the vertical surface of the outer C-channels 30L and 30R, see FIG. 3. With the cross tie members establishing the separation between the outer C-channels 30L and 30R, the inner C-channels 28L and 28R are now slid into contact with the other Channels 30L and 30R along their horizontal surfaces 33 and are welded together along line 32, see FIG. 4. The final step in the preferred method of manufacturing the boom assembly is to secure the cross tie members 34 to the inner C-channels 28L and 28R by welding along their contact surfaces which are the circumferences of the cross tie apertures 36.

An examination of the structure shown in FIG. 6 will explain the relationship of the boom assembly elements when the assembly procedure has been completed. This sectional view shows the end 38 of the cross tie member 34 welded to the inner surface 40 of the outer C-channel 30L, with the inner C-channel 28L being welded to the outer C-channel 30L along line 32. The final welding step of the preferred procedure is the welding of the cross tie member 34 to the inner C-channel 28L around the circumference of the cross tie aperture 36.

Further examination of the structure disclosed in FIG. 5 reveals that the preferred embodiments welding of the cross tie member 34 to the verticle surfaces 42 of the inner and outer C-channels combined with the welding of the horizontal surfaces 44 of the inner and outer C-channels produces a structural arrangement for a boom that increases the twist strength of the boom while minimizing the effects of stress risers and the rust producing environment on the boom assembly.

In addition with reference to the above description of the preferred procedure in FIG. 4 it will be apparent that the preferred procedure allows the use of guide pins through the boom pivot apertures 46 and bucket pivot apertures 48 to establish the welding position of the inner and outer C-channels to minimize the accuracy necessary in the bending of the C-channels from the flat punched plate. In the alternative the preferred procedure could also utilize the cross tie apertures 36 and the cross tie members 34 as the sole alignment mechanism necessary to position the inner and outer C-channels for their weldment.

Thus it is apparent that there has been provided, in accordance with the invention, a boom assembly and manufacturing procedure therefore that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A boom assembly for a loader pivotally mounted on a tractor and movable supporting a material handling member, wherein the improvement comprises:

a pair of boom arms having one end pivotally connected to said tractor and having a second end movably supporting said material handling member, said boom arms comprising;

a pair of matched inner and outer C-channels having horizontal and vertical surfaces welded at the contact edges of said horizontal and vertical surfaces welded at the contact edges of said horizontal surfaces to form a box boom arm, with only said inner C-channels having aligned cross tie apertures in said vertical surfaces forward of said tractor;

a cross tie member passing through said aperatures and welded to said vertical surface of said inner C-channel and to said vertical surface of said outer C-channel.

2. The boom assembly of claim 1 wherein said cross tie aperture is annular and said cross tie member is tubular.

* * * * *